United States Patent [19]

Lawarre, Sr. et al.

[11] Patent Number: 5,058,632

[45] Date of Patent: Oct. 22, 1991

[54] FILLING VALVE APPARATUS

[75] Inventors: Robert W. Lawarre, Sr., Cocoa; Robert W. Lawarre, Jr., Titusville, both of Fla.

[73] Assignee: Precision Metalcraft Corporation, Titusville, Fla.

[21] Appl. No.: 519,655

[22] Filed: May 7, 1990

Related U.S. Application Data

[62] Division of Ser. No. 383,880, Jul. 20, 1989.

[51] Int. Cl.[5] ..... B65B 31/00

[52] U.S. Cl. ..... 141/39; 141/40; 141/59; 141/147; 141/301

[58] Field of Search ..... 141/39, 40, 6, 301, 141/302, 286, 59, 147, 148

[56] References Cited

U.S. PATENT DOCUMENTS

| | | | |
|---|---|---|---|
| 3,699,740 | 10/1972 | Knabe | 141/39 X |
| 4,386,635 | 6/1983 | Ahlers et al. | 141/6 |
| 4,398,575 | 8/1983 | Brandon | 141/39 |
| 4,589,453 | 5/1986 | Weiss | 141/39 |

FOREIGN PATENT DOCUMENTS

| | | | |
|---|---|---|---|
| 2007896 | 8/1971 | Fed. Rep. of Germany | 141/39 |
| 2815740 | 10/1979 | Fed. Rep. of Germany | 141/39 |
| 0962290 | 7/1964 | United Kingdom | 141/40 |

*Primary Examiner*—Ernest G. Cusick

*Attorney, Agent, or Firm*—Reising, Ethington, Barnard, Perry & Milton

[57] ABSTRACT

A filling valve assembly (10) is provided for use in filling containers (50) with a carbonated liquid or other type of liquid. The assembly (10) includes a housing (11) having a filling orifice (40) for allowing liquid to flow therethrough. A valve element (13) is located within and movable through the housing (11) and includes a valve seal (36) movable against the housing (11) for selectively opening and closing the filling passage (40). A capillary screen (38) is connected above the valve seal (36) and is moveable therewith. The orifice (40) is aerodynamically shaped and has an annular enlarged portion (72) smoothly feeding into a narrowed venturi area (76) to continually compress the liquid, and then into an expanded area (70) to the walls of the container (50). A container seal (110) forms part of the expanded area (70) to enhance the laminar flow.

8 Claims, 2 Drawing Sheets

FILLING VALVE APPARATUS

RELATED APPLICATIONS

This is a divisional of U.S. Ser. No. 380,880, filed July 20, 1989.

TECHNICAL FIELD

This invention relates to the field of filling containers such as bottles and cans with carbonated liquids, and more particularly to an improved filling valve for use in machinery for filling such containers.

BACKGROUND ART

Automatic machinery is used in modern bottling facilities for filling containers with gaseous liquids containing carbon dioxide and similar carbonations under counter-pressure which enables predetermined quantities of liquid to be delivered into the containers. This machinery comprises mechanisms for handling the containers in which the empty containers are raised until the neck engages the filling device in order to receive a predetermined volume of liquid at which time the containers are lowered and directed toward the capping machine. The filling machinery includes a reservoir containing a liquid which flows under the effect of gravity. The gas above the liquid maintains the carbon dioxide in the liquid and is used to charge the container. A filling valve is located in the reservoir and extends through the tank. The valve connects the reservoir with the empty container and opens to allow the container to be filled with liquid.

When the container is engaged in the filling device, the gas valve fills the container with a counter pressure gas. The bottle is then filled with liquid by opening the filling valve. During filling, the gas contained in the container is evacuated through a vent tube towards a gas chamber in the tank. As soon as the level of liquid in the container reaches the aperture of the vent tube, the gas, which is located in the neck of the container, can no longer escape and the flow is stopped. The liquid and gas valves are then closed. A snifter is operated to release the remaining pressure in the container.

The valves are generally controlled by synchronized cams actuating so that the gas is first admitted to the container, filling the container against counter-pressurizing gas until the pressure of the gas and the liquid are equal. A second valve is then opened allowing the liquid to flow into the container under the influence of gravity and under a pressure head. When the container is filled, the cam actuator closes the valve and the container is lowered for capping. The pressure in the neck of the container may be controllably released by a snifter valve and the container quickly capped and crowned.

One prior art filling valve used with a carbonated liquid bottling machine is disclosed in U.S. Pat. No. 4,089,353 to Antonelli in which a filling valve is shown which connects a container to be filled with a tank containing supply of liquid with which the container is to be filled and pressurized gas. In the Meyer U.S. Pat. No. 3 3,500,879 a counter pressure type filler valve for introducing liquids into containers from a is provided with a swirl inducing member. Another typical control valve for filling containers with liquid under gaseous pressure from a reservoir is disclosed in U.S. Pat. No. 3,385,327 to Granier. The Fernades U.S. Pat. No. 4,086,943 shows a valve for filling containers with pressurized drinks. This patent is a typical back pressure filling valve for containers and provides an auxiliary passage for air and gas and a frustocontical check valve for an elastimeric material to control the passage therethrough. The Dichiara U.S. Pat. No. 4,349,055 is for a filling valve for beverage container filling machines and is a cam operated valve having a screen filter mounted therein along with an auxiliary opening for the feeding of the liquid therethrough. The Kaiser U.S. Pat. No. 3,633,635 is for a filling element for counter pressure filling machines and includes a vessel or container for liquid and gas positioned beside the valve. The Yun U.S. Pat. No. 4,442,873 discloses a liquid filling valve for filling containers with carbonated liquid which has concentric valves for introduction of counter-pressure gas and liquid into the container.

The problem with these types of assemblies is that sharp angles and component obstructions create turbulence which separates and releases absorbed gas from the liquid and therefore foam in the bottle. The position of the screen in the high pressure area also produces additional foaming. Additionally, the screen position further restricts the flow.

SUMMARY OF THE INVENTION AND ADVANTAGES the invention is a filling valve apparatus for use in filling container with a carbonated liquid comprising housing means having an orifice for allowing liquid to flow therethrough and including an inlet for allowing liquid to flow into the housing means and the orifice, an outlet to allow liquid to flow out of the housing means and said orifice, and having a valve seat between the inlet and the outlet. Also included is valve means moveable within the orifice between the inlet and the outlet and including sealing means moving against the valve seat for preventing the liquid from flowing through the orifice to the outlet and moving away from the valve seat for allowing liquid to flow through the orifice to the outlet. The assembly is characterized by including capillary screen means connected to the valve means at a position between the inlet and said sealing means.

The invention also includes the housing means comprising a cylindrical portion with an inner surface establishing a vertical cylinder having apertures establishing the inlet, a valve portion connected to the cylindrical portion with an inner surface bowing outwardly from the cylinder, a venturi portion connected to the valve portion having an inner surface funneling inwardly, and an expansion portion connected to the venturi portion with an inner surface flaring outwardly to a base portion establishing a horizontal shoulder for receiving a container wherein the liquid flowing along expansion portion is directed to the inside surface of the container. Valve means extends through the housing means wherein liquid flows along the inner surfaces between the housing means and the valve means. The valve means includes sealing means for moving between an open and closed position and having and external contour substantially complementing the inner surface of the valve portion such that the liquid flowing therethrough is compressed between the cylindrical portion and valve portion and the venturi portion.

The invention also provides the valve means comprising a valve stem having a passageway therethrough and extending through the orifice of the housing means and having a first end allowing gas to enter the passageway and a second end connected to the sealing means, and the assembly characterized by including cap means having a cylindrical sleeve for receiving the first end of the valve stem and having an annular shoulder for receiving and securing variable machining interfaces thereto.

A shortened distance in the orifice for the frame of fluid combine with the removal of any obstructions such as springs and screens combine to increase the flow speed with out undue foam. The screen being above the valve in the low-pressure area allows for little turbulence. Furthermore, the aerodynamic shape of the inside of the housing provides for a decrease in turbulence which prevent foaming. Additionally, the cap member may receive various types of actuating mechanisms, such as cam or lever actuators.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 2:
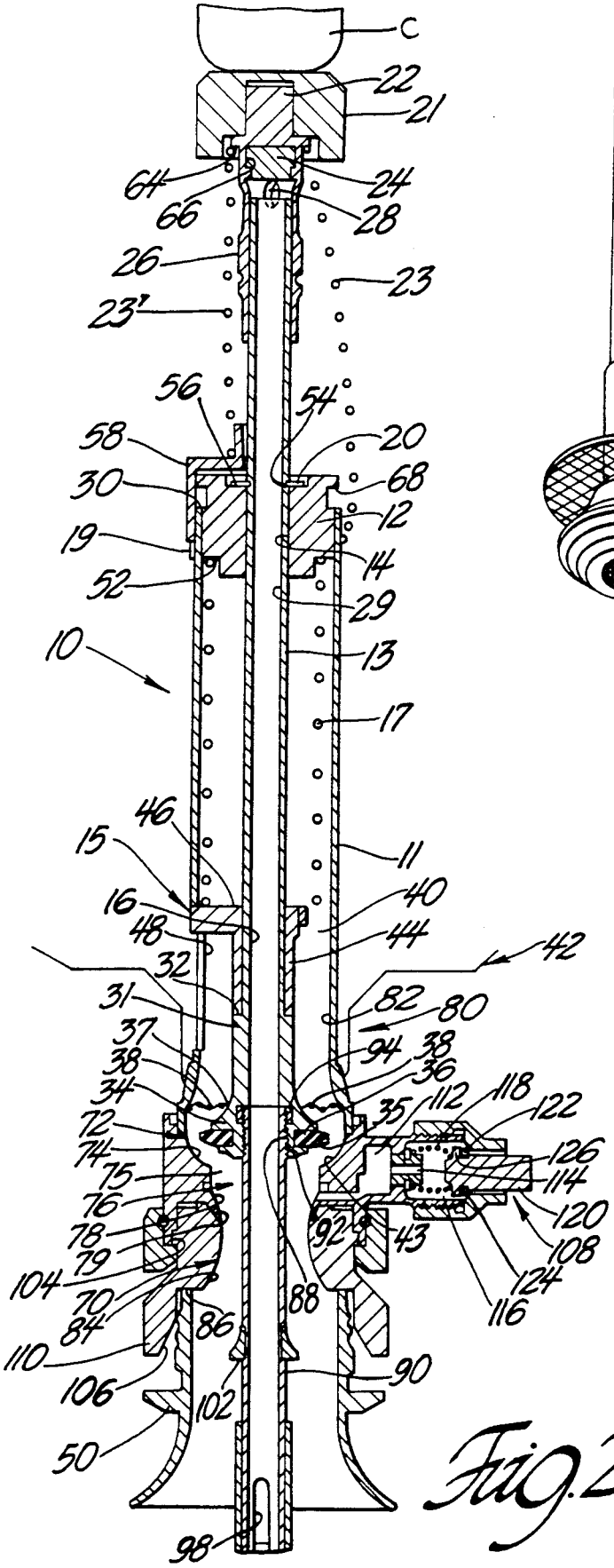
FIG. 2 is a cross-sectional view of the subject invention in the open and filling position.
Figure 3:
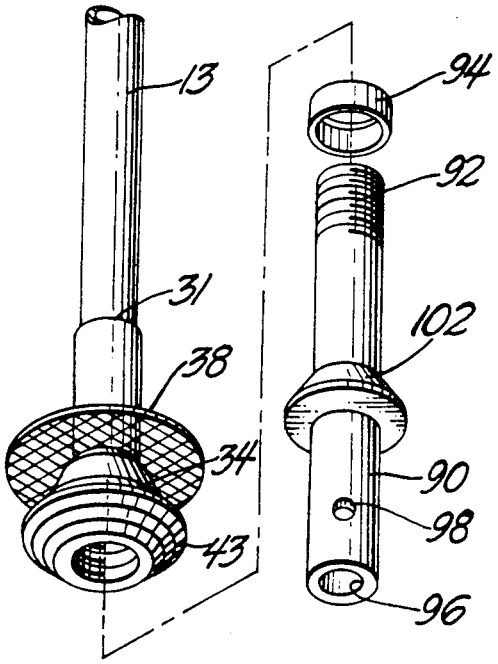
FIG. 3 is an exploded perspective view of a valve in accordance with FIGS. 1 and 2.
Figure 1:
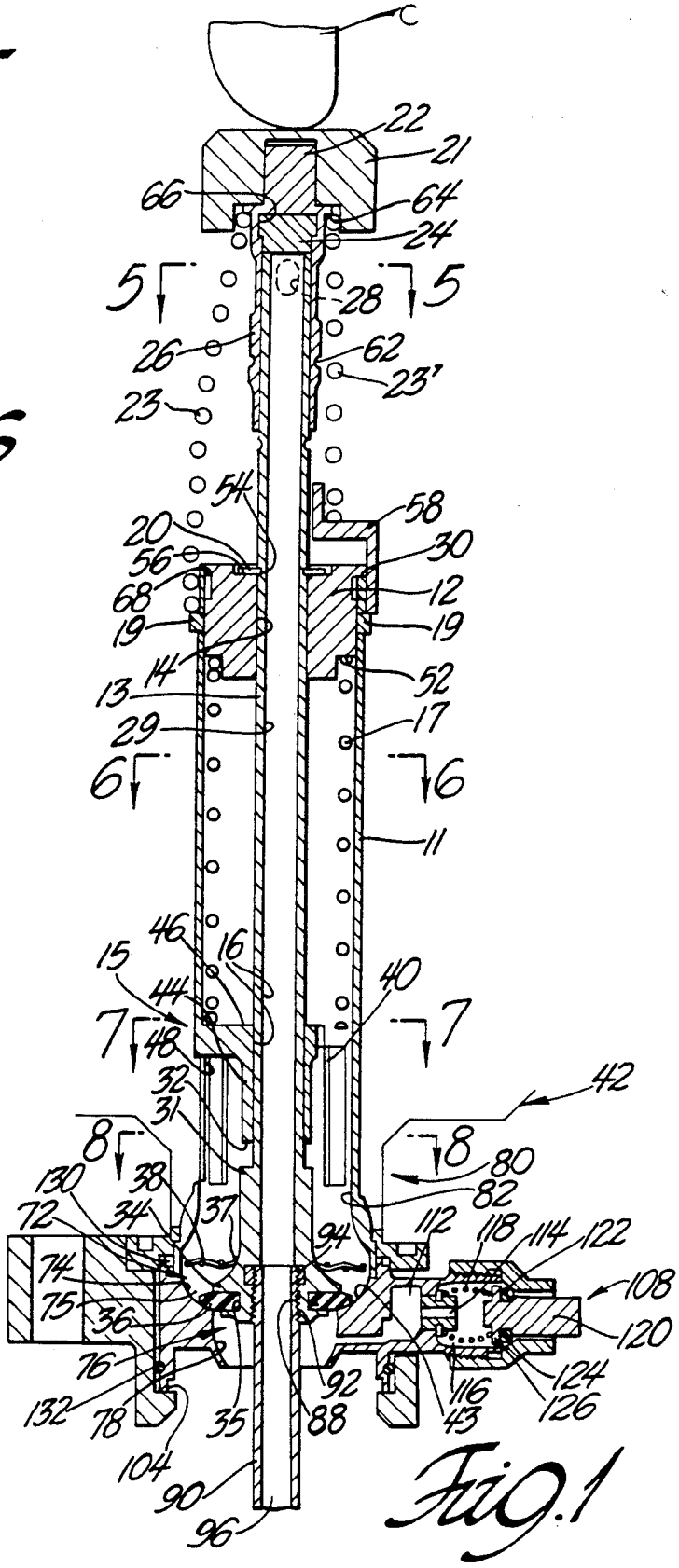
FIG. 1 is a cross-sectional view of a portion of the subject invention in the closed position.

A filling valve assembly for filling containers with a liquid is generally shown at 10 in FIGS. 1 and 2. Generally, filling machines utilizing such assembly 10 may be provided with a moveable filling table having a plurality of vertically moveable container supports which are spaced about the circumference of the table and adapted to receive containers such as bottles, cans or the like. The supports raise the containers into sealing engagement with the valve assembly 10 where the containers 50 are filled with a carbonated liquid, and thereafter lowered and removed from the platforms.

The filling machines are provided with a filling reservoir 42. The reservoir 42 is supplied with a carbonated liquid which may be a pre-mixed liquid comprising syrup, fruit pulp, or the like. The carbonated liquid is supplied to the reservoir 42 through connections as are commonly known in the art. One filling valve assembly 10 is in vertical alignment with each container 50. A body of gas or air at a suitable pressure, such as 40 psi, is supplied to the upper portion of the filling valve assembly 10 and reservoir 42; the pressure of the gas or air is maintained at a desired pressure as commonly known in the art.

The filling valve 10 includes a generally cylindrical housing 11 having a passage 40 therethrough. An upper valve stem guide 12 is slideably mounted within the passage 40 of the housing 11 and has an aperture 14 therethrough. The upper valve stem guide 12 is generally cylindrical in shape. A fluid valve stem 13 having a gas passageway 29 therethrough is slidingly retained within the aperture 14 in the valve stem guide 12 providing liquid flow area between the housing 11 and valve stem 13. A lower valve stem guide 15 has an aperture 16 therein for receiving the valve stem 13 in sliding connection therewith. The lower valve stem guide 15 comprises a cylindrical sleeve portion 44 adjacent the valve stem 13 providing the aperture 16 and including radially extending spokes 46 connected to the housing 11. The lower valve stem guide 15 is formed as an integral part of the housing 11. The housing 11 includes longitudinally extending side openings 48 extending adjacent the spokes 46 and extending longitudinally downwardly therefrom to allow the liquid to flow into the passage 40.

A lower coiled spring 17 is supported in the housing 11 between the upper and lower valve stem guides 12 and 15. The coiled spring 17 is a compression spring to bias the lower guide 15 away from the upper guide 12 and downwardly along the valve stem 13. The lower valve stem guide 15 provides a shoulder at the upper surface of the radial spokes 46 for receiving the first end of the coiled spring 17, while the upper valve stem guide 12 provides the upper radial groove 52 for receiving the second end of the coiled spring 17. A retainer 20 is provided to lock the valve stem 13 to the upper valve stem guide 12 so that the upper valve stem guide 12 slides with the valve stem 13 whenever it is driven by a cam C against a cam follower 21 as subsequently described. The valve stem 13 provides a groove 54 for receiving the retainer means 20, which is generally a washer, and the upper valve stem guide 12 provides a recess 56 for receiving the washer 20.

A cap member 22 is supported at the upper end of the valve stem 13 for supporting the cam follower 21. The cap member 22 includes an extending sleeve 26 extending adjacent the upper portion of the stem 13, and includes gas escape apertures 28 near the upper edge of the sleeve 26 and the valve stem 13. The apertures 28 are spaced circumferentially about the sleeve 26. A charging cap 24 is retained within the cap member 22 adjacent the upper edge of the valve stem 13 in its closed position. The charging cap 24 provides an upper shoulder 64 and the cap member 22 provides inwardly extending flanges 66 for engagement within the shoulders 64 of the charging cap 24 for retainment therebetween. The valve stem 13 is slideably retained within the sleeve 26 to a position adjacent the charging cap 24 to close the gas apertures and therefor prevent the supply of gas through the valve stem 13 and to a lower position to allow gas to flow into the apertures 28 above the upper edge of the valve stem 13. The cap member 22 is able to be snapped into engagement with the charging cap 24 and the valve stem 13 slid therein.

Also included is an upper coiled spring 23 extending between the housing 11 and the cap member 22. The upper coiled spring 23 is a compression spring which operates to bias the cap member 22 to follow the cam C movement and open and close the gas apertures 28.

Figure 4:
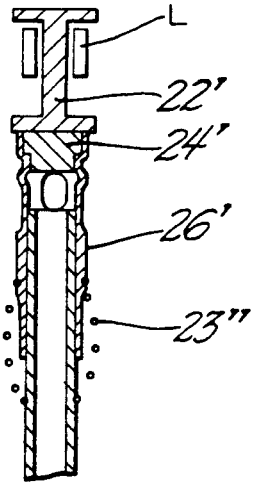
FIG. 4 is a cross-sectional view of a second embodiment of the cap member in the open position.
Figure 5:
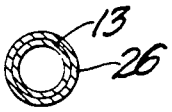
FIG. 5 is a cross sectional view taken along lines 5—5 of FIG. 1.
Figure 6:
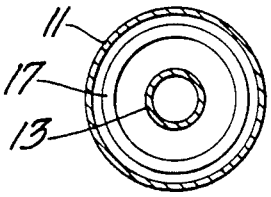
FIG. 6 is a cross-sectional view taken along lines 6—6 of FIG. 1.
Figure 7:
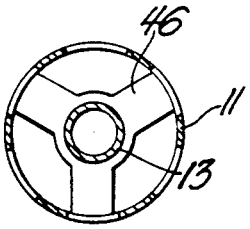
FIG. 7 is a cross-sectional view taken along lines 7—7 of FIG. 1.
Figure 8:
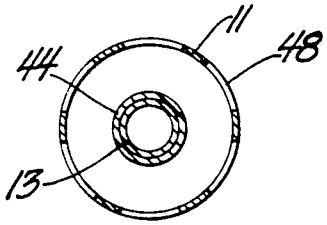
FIG. 8 is a cross-sectional view taken along lines 8—8 of FIG. 1.

The housing 11 includes an outwardly extending, circumferential flange 19 for receiving the lower end of the upper spring 23. The upper coiled spring 23 is bowed from a smaller diameter received by the cap member 22 adjacent the valve stem 13 to a larger diameter received on the flange 19 providing clearance between the diameter changes. Only one half of the upper spring 23 is illustrated in FIGS. 1 and 2. As an alternative embodiment as shown in FIGS. 1 and 2, an annular bracket 58 (only a portion of which is shown) may be included to be supported on the flange 19 and extending upwardly along the housing and inwardly to a sleeve adjacent the valve stem 13 inside the spring 23'. The spring 23' in this embodiment is a coiled spring of uniform diameter. A second alternative embodiment is utilized particularly in the lever actuated system and is shown in FIG. 4, as subsequently described, and includes the upper coiled spring 23'' bowed outwardly with uniform end diameters; the ends are received and retained by a radial notch 60 in the cap sleeve 26' and a radial notch 62 (best shown in FIG. 2) in the valve stem 13.

The upper valve stem guide 12 further includes a radially extending ridge 68 at its upper end to move against the upper edge 30 of the housing 11 preventing further downward movement of the upper valve stem guide 12 and valve stem 13 into the housing 11. When a cam C pushes against the cam follower 21, the valve stem 13 slides until the ridge 68 of the valve stem guide 12 abuts against the edge 30 of the housing 11 as shown in FIG. 1. The valve stem 13 is spring biased by the upper coiled spring 23 to return as the cam moves against the follower 21 allowing the valve stem guide 12 to slide out of the housing 11. The valve stem 13 provides a lower annular stop 31, and the lower stem guide 15 provides a stop 32 at its lower edge. As the cam follower 2 moves upwardly, the valve stem 13 and upper guide 12 slide out of the housing 11 until the valve stem annular stop 31 abuts against the lower stop 32.

The valve stem 13 includes a valve head 34 having an annular, outwardly curved and bowed portion forming a sloping, substantially symmetrical flange. The head 34 has an annular groove 35 formed therein at the outer diameter for supporting a resilient valve seal 36. The resilient valve seal 36 is radially extending outwardly from the groove 35 and may be made of rubber or other soft non-porous material. A second annular groove 37 is provided to receive a capillary screen 38 therein at a position above the valve element 36 along the sloping portion of the valve stem 13. The capillary screen 38 extends outwardly and radially from the stem 13 and has a downwardly curved radial edge. The screen 38 extends outwardly a distance to contact the inside surface of the housing 11 when in the open position, and provide slight distance between the edge and inside surface when moving to and in the closed position.

The housing 11 provides the side openings 48 of elongated shape for allowing the liquid to enter from the reservoir 42 therethrough below the coil spring 17 and spokes 46. The fluid is blocked by the valve seal 36 seated in a valve seat 43, as shown in FIG. 1. The valve seal 36 is open in FIG. 2 to allow the fluid to proceed to outlet 70.

The area through the housing 11 through which the liquid flows forms a shaped orifice including an enlarged chamber or valve portion 72 having annular arcuate walls 74 in which the screen 38 and valve seal 36 are situated forming the enlarged area and a second curved portion curving into a venturi portion 76 formed just below the valve seat 43, which has a continuous smooth flow into a continuous expansion orifice portion or outlet 70 and into a container 50.

The housing means 11 includes inner surfaces forming the passage 40 therethrough. The housing 11 includes the inlet or side opening 48 for allowing liquid to flow into the housing 11 and an outlet or the expansion orifice 70 to allow the liquid to flow out of the housing and liquid passage 40. The housing 11 includes a cylindrical portion 80 a first flow area wherein the inner surface 82 provides a vertical cylinder having a smooth surface with openings for the inlet 48. The cylindrical portion 80 is adjacent and below the spokes 46. The cylindrical portion 80 is connected to the valve portion or enlarged chamber 72 of a second flow area with the inner surface 74 bowing outwardly from the cylindrical portion and bowing inwardly providing the valve seat 43 to the venturi portion 76. The valve portion 72 contains the enlarged head 34 and seal 36 and screen 38. The screen 38 contacts the upper area of the enlarged chamber 72 in the open position, and is near the center of the enlarged chamber 72 in the closed position.

The valve portion 72 is connected to the venturi portion 76 of a third flow area having the inner surface 78 funneling inwardly a conical portion comprising the expansion orifice 70. The conical portion 70 starts at the third flow area and expands therefrom. The conical portion is connected to the venturi portion 76, with the inner surface 84 flaring outwardly to a base portion 86. The base portion 86 establishes a horizontal shoulder for receiving the container 50 wherein the liquid flowing along the conical portion 70 is directed to the inside surface of the neck of the container 50, rather than flowing to the upper edge of the container 50 causing turbulence.

The valve stem 13 extends through the housing 11 wherein the liquid flows along the inner surface, between the housing 11 and the valve stem 13. The above described flow areas are taken between the housing 11 and the valve stem 13 including the structural protrusions therefrom. The valve stem 13 and spokes 46 are in contact and abutting in the open valve position providing a smooth surface therealong for the flow of liquid. The valve stem 13 includes the valve seal 36 for moving between an open and closed position. The valve head 33 and valve seal 36 provide an external contour substantially similar to and complementing the contour of the inner surface 74 of the valve portion 72 or enlarged portion to maintain a constant flow area through the valve portion 72. The effective area of the various portions through which the liquid flows decreases between the cylindrical portion 80 and the valve portion 72, and the venturi portion 76. The purpose of the curved aerodynamic surfaces and housing 11 prevents any agitation and turbulence of the liquid and therefore prevents foaming at the outlet. Furthermore, by decreasing the flow area until reaching the outlet, the pressure is increased which prevents foaming by not allowing the carbonated liquid and gas therein to expand causing foaming. The lower valve portion 72 and venturi portion 76 and outlet 70 are formed by the adjustable container seal 51, as subsequently described. By continually decreasing the flow area, the liquid is continually compressed so the gas may not expand therein prior to flowing into the container 50 which would cause additional foaming. Furthermore, the liquid may flow through the housing 11 without any obstructions, along the smooth, aerodynamic walls or surfaces to preserve the capillary action of the fluid.

The valve stem 13 includes at the head 34 a threaded bore 88 for receiving a vent tube 90 having threads 92 to be received within the valve head 33, and includes an annular resilient seal 94 therein for sealing the vent tube 90 to the stem 13. The vent tube 90 is effectively an extension of the valve stem 13. The vent tube 90 has an open bottom 96 and a pair of side apertures 98. The vent tube 90 also has an annular liquid spreading member 102 positioned below the venturi portion 76 and the spreading area 70 formed by the inner surface 84 of the expansion orifice to spread the liquid in the neck of the container 50. When the liquid filling the container 50 raises to cover the side apertures 58, the gas pressure is cut off which stops the flow of liquid into the container 50 preventing further filling thereof.

A container seal 110 may be a resilient rubber member and includes the curved area or expansion orifice 70 and fits into an annular grooved area 104 in a snifter 108, as subsequently discussed. A cone shaped end 106 guides the container top 50 into place.

The snifter 108 is mounted to one side of the valve 10 and has an insert 112 with a small bore 114. This insert is changeable to change the size of the aperture therethrough to match the valve and bottle seal 110 and varies the snift speeds in accordance with the opening therethrough. The snifter 108 includes a chamber 116 having a coil spring 118. A button 120 has an O-ring seal 122 in a grooved area 124 and an annular ledge 126 for supporting the coil springs 118. The seal 122 acts as a valve element against a valve seat area while the bore 114 connects into the venturi area 76 of the orifice of the valve 10. An O-ring seals 130 and 132 seal valve 10 in place so that the liquid leak therethrough. The snifter 108 provides a housing, which forms the inner surface 75 of the lower valve portion, and venturi portion 76. The bottle seal 51 forms the expansion orifice or conical portion 20.

The short distance between the feeding of the fluid through the opening 48 and into the container 50 along with the aerodynamic shape of the feeding orifice provide a faster fill for the bottles and this is further enhanced by a capillary action and columnar effect of the fluid.

The valve assembly 10 may be operated by a cam or lever. The charging cap 24 provides the shoulders 64 for receiving the first alternative cap member 22. As illustrated in FIG. 1, the cap member 22 is for receiving a cam follower 21 thereon to be operated by a cam C. Alternatively, as illustrated in FIG. 4, the cap member 22' for a lever actuator is generally spool shaped for receiving a lever L about the stem of the spool. In either cap member embodiment 22, 22', the charging cap 24 is common. Furthermore, both cap retainer embodiments 22, 22' include the sleeve 26, 26, as hereinbefore described. However, the lever actuated cap member 22' utilizes the symmetrical bowed spring 23'', and the cam actuated retainer 21 may utilize either the cone-shaped spring 23 or the cylindrical spring 23'.

In operation, a cam C or lever L operates against the cam follower 21 or lever member 22' to drive the valve stem 13 downward against the coiled springs 23 and 17 until the upper valve stem guide 12 hits the stop 30 and the cam reaches the bottom of its drive. The valve element 36 is pressed against the valve seat 43. The upper spring 23 holds the cam follower 21 tightly against the cam at all times. The container 50 is then pushed into place in the bottle sealing rubber 51, with the stem 14 and the vent tube 90 pushed into the container 50.

The cam C or lever L is operated to move the cap member 22, 22' upwardly to positively open and place the inside of the container 50 in open communication with the superposed body of gas in the reservoir 42. Gas will quickly flow into the container 50, filling the same to a pressure substantially equal with the pressure of gas in the reservoir 42.

During this filling operation, the stem 13 and the vent tube 90 are retracted slightly to open the valve by pulling the valve element 36 off the valve seat 43 as shown in FIG. 2 to allow the carbonated liquid to pass through the opening 48 into the enlarged valve chamber 72 through the capillary screen 38 which is curved to fit against the upper curved area of the enlarged chamber 72. The enlarged area 72 of the orifice has a lower pressure, a lower velocity and feeds the carbonated liquid therethrough. The liquid passes through the venturi portion 76 where the velocity is substantially increased with a rise in pressure and as it passes the venturi area 76 it passes between the spreading member 60 and the expanding walls 84 and is fed into the container 50.

The short distance between the feeding of the fluid through the opening 48 and into the container 50 along with the aerodynamic shape of the feeding orifice without obstructions, such as springs and screens, provide a faster fill for the bottles. This is further enhanced by the capillary screen 38 being positioned above the valve seat in an enlarged area rather than below the valve element or below the venturi. The container seal 51 form part of the expansion of the venturi 76 and provides a smooth continuous laminar flow or capillary action of the liquid through the valve into the bottle to thereby reduce foam and allow more rapid filling of the bottles. The snifter 108 has also had the aperture enlarged and it interchangeable with different size apertures to also prevent foam for an adjusted filling speed. The valve seat 43 is also formed as part of the aerodynamic shape in an enlarged area 72 over the venturi 76. The pressure changes as the liquid passes through the venturi 76 and is rapidly dispensed into the container 50 by the liquid spreading member 102. The container 50 is filled, until the pressure is counter-balanced to indicate a full container 50.

The screen 38 automatically stops the flow of liquid into the container 50 when the pressure of the gas in the head of the container 50 is balanced with the pressure of the liquid above the screen 38. The natural surface tension of the liquid on the screen 38 will prevent further liquid from flowing into the container 50, thereby maintaining the fill height of each container 50 substantially equal. When the liquid flowing into the container 50 fills up past the aperture 98, there is no where for the gas in the head space of the container 50 to escape and consequently the pressure of the gas in the head space will build up as liquid flows into the container until it is substantially equal to the pressure of the liquid flowing through the screen 38 and liquid passage. At this instant, the liquid flow into the container 50 will stop. The mesh of the screen 38 depends upon the viscosity and surface tension of the liquid. The screen 38 includes an annular, downwardly curved edge about its periphery. The curved edge is advantageous when using pulp containing liquids to bring the pulp to the edge when the filling if stopped and the valve closed, so that the pulp is the first to flow out the valve assembly 10 during the next filling operation.

Once the container has been filled, the valve assembly 10 moves to a position gas closing the apertures 28 and valve 36. The snift valve 108 is then operated by a fixed cam (not shown) on the frame of the filling valve assembly 10 and places the head space of the container 50 in open communication with atmosphere. Any excess pressure in the head space of the container is released through the snifter 62 to atmosphere.

After the snift stage, the container 50 is lowered away from the filling table and conveyed to suitable container closing mechanism. The bottle 50 is then moved on a conveyor quickly to a capping station where it is capped.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A filling valve assembly for filling containers with a liquid, said assembly comprising:

housing means (11) having a passage (40) and including an inlet (48) for allowing liquid to flow into said housing and said passage (40) and an outlet (70) to allow liquid to flow out of said housing means (11) and said passage (40);

said housing means (11) including cylindrical portion (80) with an inner surface (82) establishing a vertical cylinder having apertures (48) establishing said inlet (48), valve portion (72) connected to said cylindrical portion (80) with an inner surface (74) bowing outwardly from said cylinder, venturi portion (76) connected to said valve portion (72) having an inner surface (78) funneling inwardly, and expansion portion (70) connected to said venturi portion (76) with an inner surface (84) flaring outwardly to a base portion (86) establishing a horizontal shoulder for receiving a container (50) wherein the liquid flowing along said expansion portion (70) is directed to the inside surface of the container (50);

valve means extending through said housing means (11) wherein liquid flows along said inner surfaces (74, 78, 82, 84) between said housing means (11) and said valve means;

said valve means including sealing means (36) for moving between an open and closed position and having an external contour substantially complementing said inner surface (74) of said valve portion (72) such that the liquid flowing therethrough is compressed between said cylindrical portion (80) and said valve portion (72) and said venturi portion (76).

2. An assembly as set forth in claim 1 further characterized by said valve stem (13) including an enlarged portion (33) for supporting said sealing means (36), said sealing means (36) moveable with said valve stem (13).

3. An assembly as set forth in claim 2 further characterized by including said valve means including a valve stem (13) extending through said housing means (11) and having a passageway (29) for allowing a gas to pass therethrough.

4. An assembly as set forth in claim 3 further characterized by including lower guide means (15) secured to said housing means (11) and providing a shoulder (46) and base stop (32), and including an aperture (16) for slideably retaining said valve stem (13) therein.

5. An assembly as set forth in claim 4 further characterized by including upper guide means (12) slideably retained within said housing means (11) and connected to said valve stem (13) providing a lower shoulder (52) therein.

6. An assembly as set forth in claim 5 further characterized by including lower spring means (17) supported between said shoulder (52) of said upper guide means (12) and said lower guide means (15) for biasing said upper guide means (12) away from said lower guide means (15).

7. An assembly as set forth in claim 6 further characterized by cap means (22, 22') slideably connected to said valve stem (13) having gas apertures (28) therein for allowing gas to pass therethrough into said passageway (29) of said valve stem (13).

8. An assembly as set forth in claim 7 further characterized by including upper spring means (23) supported between said cap means (22, 22') and said housing means (11) for biasing said housing means (11) away from said cap means (22).

* * * * *